US005875912A

United States Patent [19]

Hobson

[11] Patent Number: 5,875,912

[45] Date of Patent: Mar. 2, 1999

[54] ADJUSTABLE AND EXTENDABLE RECEPTACLE

[76] Inventor: Richard G. Hobson, 7140 Royston Way, Cumming, Ga. 30040

[21] Appl. No.: 909,155

[22] Filed: Aug. 11, 1997

[51] Int. Cl.[6] ..... B65D 6/16

[52] U.S. Cl. ..... 220/4.03; 220/8; 220/629; 220/636

[58] Field of Search ..... 220/8, DIG. 25, 220/628, 629, 630, 636, 565, 567, 4.03, 4.21

[56] References Cited

U.S. PATENT DOCUMENTS

| | | | |
|---|---|---|---|
| D. 275,406 | 9/1984 | Battle . | |
| 2,446,669 | 8/1948 | Satchik | 220/8 |
| 2,456,817 | 12/1948 | Davenport | 220/8 |
| 3,920,147 | 11/1975 | Hiatt | 220/630 |
| 4,505,408 | 3/1985 | Sagol | 220/629 |
| 5,462,213 | 10/1995 | Watt | 200/629 |
| 5,544,764 | 8/1996 | Cima . | |
| 5,598,921 | 2/1997 | Hunt . | |

FOREIGN PATENT DOCUMENTS

| | | | |
|---|---|---|---|
| 000356306 | 2/1990 | European Pat. Off. | 220/8 |

*Primary Examiner*—Stephen Castellano
*Attorney, Agent, or Firm*—William B. Noll

[57] ABSTRACT

Invention relates to an adjustable and extendable receptacle, adapted primarily for use at a computer workplace, for the storage and retrieval of office-type items. The receptacle includes a pair of interengagable trough-like members, telescopically engaged, a pair of vertically adjustable legs and a further set of pivotally mounted legs.

6 Claims, 1 Drawing Sheet

ADJUSTABLE AND EXTENDABLE RECEPTACLE

FIELD OF THE INVENTION

This invention relates generally to the field of computer accessories, and more particularly to an organizer for temporarily receiving, displaying and retrieving office type items and photographs, where such organizer may be placed adjacent to or on top of a computer monitor.

BACKGROUND OF THE INVENTION

The invention, in a preferred embodiment, is directed to a computer workplace accessory, such as an adjustable and extendible receptacle for storing and retrieving necessary office items.

Typically, a computer desk is provided with a sliding keyboard shelf disposed a few inches below the desktop and mounted on slides so that it can be pulled forward to a working position for the operator, and pushed back under the main desktop for storage. In the operating position, a mouse unit is generally adjacent the computer monitor and freely movable on a rubberized pad. Also, a printer unit, in signal communication with the computer, is often positioned on the desktop nearby, thus leaving less and less space accessible to the operator for storing necessary office items, or even photographs that often adorn a workplace.

U.S. Pat. No. 5,598,921 is a recent example of a computer workplace organizer for storing floppy disks, pens and pencils, and providing access for the mouse. The organizer thereof is a one-piece molded plastic housing that is mounted to the pull-out keyboard shelf.

U.S. Pat. No. 5,265,735 discloses a modular desktop organizer for mounting to the top rear surface of a computer keyboard.

U.S. Pat. No. 5,544,764 discloses a desktop holder for pens, pencils, and other elongated items, where such holder consists of plural rows of staggered elongated chambers for receiving the pencils, etc. The lower or solid supporting surface of the holder is generally horizontal, while the upper surface communicates with the plural chambers and is inclined at an angle relative to the lower surface.

There are a numer of other static desktop receptacles, as exemplified by the following U.S. Design Patents, Nos. D-350,154, D-323,853; D-288,440; D-255,586; D-255,587; and, D-252,935.

The present invention, in contrast to the prior art as shown by the above patents, relates to an adjustable and expandible receptacle or organizer, such that it may be placed on an inclined surface, i.e. top of the monitor, for convenient access by the operator. The manner by which the organizer is adjustable and expandible will become apparent in the specification to follow, particularly when read in conjunction with the accompanying drawings.

SUMMARY OF THE INVENTION

The present invention relates to a receptacle or desk organizer that is particularly adapted for use as a computer accessory where the workplace or available desk space is at a premium. The accessory, mountable on the top of the computer monitor, for example, is an ideal place for displaying photographs, or storing necessary items, such as pens, pencils, disks, etc., useful to the operator.

The receptacle of this invention includes a pair of slidably engagable trough-like members, where each member has a floor, front and rear walls extending generally upward from the floor, and a single end wall. The respective members are slidably engagable with one another, such that in the assembled position the receptacle is four sided and may be extended or retracted as desired. The receptacle includes a pair of vertically adjustable legs along the rear of the floor, and a pair of pivotally mounted legs near the front wall along the floor. By this arrangement, the spatial relationship of the floor to an underlying, inclined supporting surface may be changed to present a generally horizontal floor for the contents of the receptacle.

DETAILED DESCRIPTION OF PREFERRED EMBODIMENT

Figures 1, 2, 3:
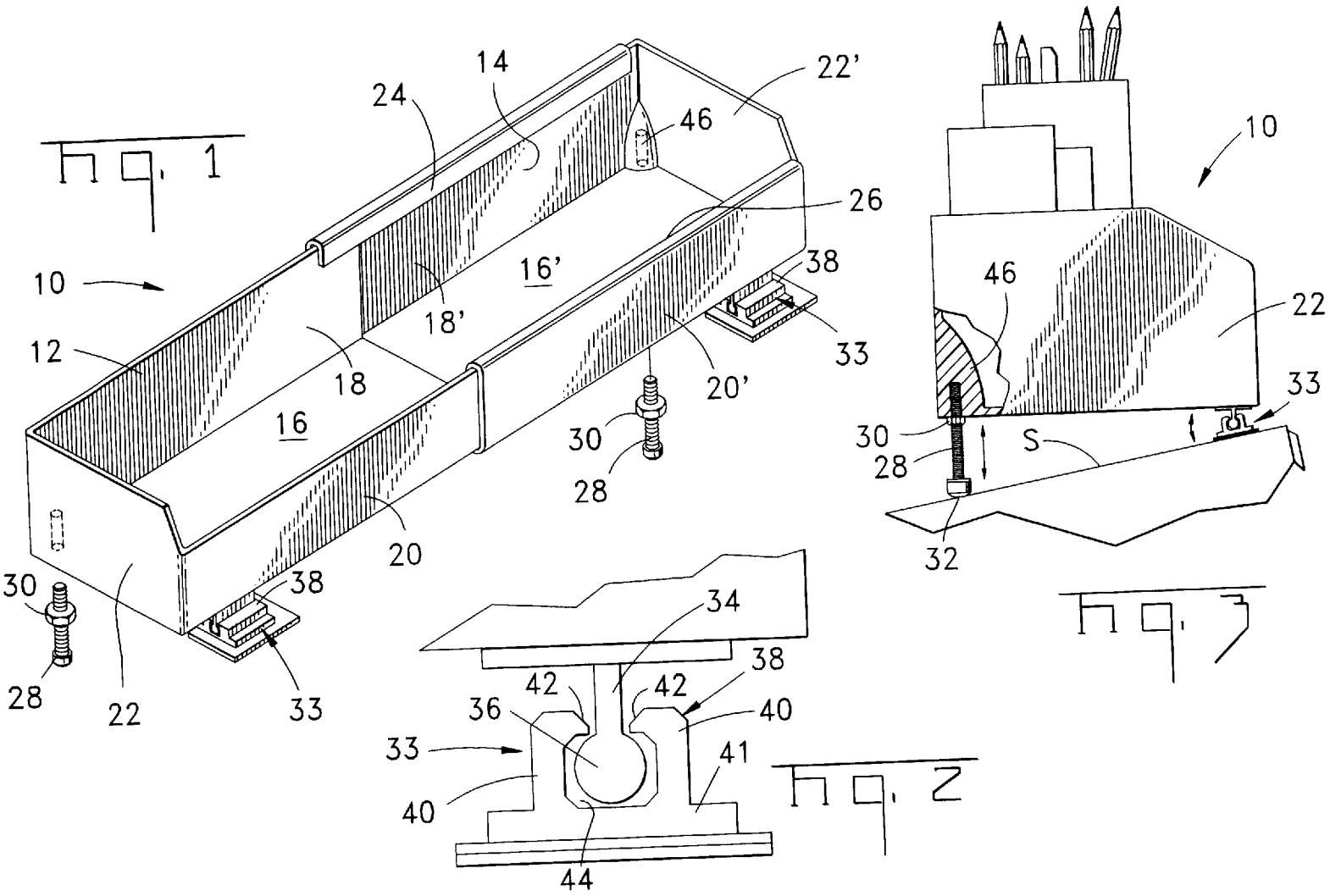
FIG. 1 is a perspective view of the adjustable and extendable receptacle, having a pair of vertically adjustable legs and a pair of pivotally mounted legs, where said receptacle is positionable on an underlying, angled supporting surface, in accordance with the teachings of this invention.
FIG. 2 is an enlarged, partial plan view of one of said pivotally mounted legs for the receptacle of this invention.
FIG. 3 is a side view, with hidden parts shown in phantom, illustrating the mounting of the receptacle hereof on an inclined surface, such as the top of a computer monitor.

This invention is directed to an adjustable and extendable receptacle that is particularly suited as a computer accessory for the storage, retrieval and display of office type items for a computer operator.

Turning first to FIG. 1, where like reference numerals refer to the same or comparable components or features throughout the drawings, there is shown a perspective view of the receptacle 10 according to this invention. The receptacle 10 comprises a pair of interengagable trough-like members 12, 14, where a first said member 12 includes a floor 16, a rear wall 18, a front wall 20, and a single end wall 22 extending generally upward from the floor 16. The second trough-like member 14, is similarly constructed with a floor 16', rear and front walls 18', 20', respectively, and a single end wall 22'. The second trough-like member 14 is dimensioned slightly larger to slidably accommodate and receive the smaller or first trough-like member 12. An additional feature of the second trough-like member 14 is the provision of a pair of flanges 24, 26, respectively, turned inwardly or toward one another along the upper edges of the rear and front walls 18', 20', whereby to securely retain the slidably engaging trough-like member 12 therein. By this arrangement, the computer operator, or user thereof, can extend or retract the receptacle to the desired size before removably securing same, as hereinafter explained, to an underlying supporting surface.

Since the top of a computer monitor, an ideal supporting surface for the receptacle of this invention, is typically inclined and not necessarily planar, means have been incorporated herein to allow for the spatial adjustment of the receptacle relative to the underlying supporting surface. A first means of adjustment is illustrated in FIGS. 1 and 3. Projecting through the floor 16, 16', in close proximity to the junction of the end walls 22, 22' and their respective said rear walls 18, 18' are threaded member 28, 28', where each said threaded member is threadably engaged with a complementary threaded bolt 30 (only one shown), which bolt is fixedly secured to the underside of the floor 16. For appearance, and to prevent marring of the underlying support surface "S", a rounded head 32 may be provided on the threaded member 28. By this arrangement, namely, the engagement of the threaded member 28 to its complementary bolt 30, the threaded member 28 may be extended from or toward the floor 16, whereby to change the relationship of the floor 16 to the surface "S".

To complement this changing relationship, the front of the receptacle 10 may be provided with a pair of floating type leg assemblies 32. Preferably the leg assemblies 32, as seen in FIGS. 1 and 2, are a pair of pivotally mounted legs. Each leg assembly 32 may comprise a stem 34 suitably secured to the underside of floor 16, 16', terminating in a balled tip 36. Cooperating with, and in sliding engagement with said balled tip 36 is an elongated channel member 38 consisting of a pair of rails 40, mounted on a base 41, and having inturned upper edges 42 to define a restricted slot 44 for slidably receiving the stem 34 (FIG. 2), with the balled tip freely movable between the rails 40. In this relationship, the base 41 may be angled along a number of planes to satisfy and be secured to the angled plane of the underlying support surface "S". In order to secure the base 41 to the surface "S" the underside of the base 41 may be provided with an adhesive type agent, such as VELCRO type fastener or peel-off tape, as known in the art.

In order to dress-up or improve the appearance of the receptacle, the threaded member 28, 28' projecting through the floor 16, 16', may be provided with a shield or cover 46 within the receptacle. Additionally, this shield or cover protects any items received in the receptacle that might otherwise come in contact with the exposed threaded members 28, 28'.

I claim:

1. An adjustable and extendable receptacle for the storage and retrieval of office-type items, where said receptacle is positionable on a supporting surface, said receptacle comprising a pair of slidably engagable trough-like members, each said member having a floor, front and rear walls extending upwardly therefrom, and a single end wall, whereby said trough-like members are slidably engagable with one another so as to provide a four sided receptacle that is telescopically extendable and retractable, a pair of vertically adjustable legs, one mounted on each said member along the underside of said floor in close proximity to said rear wall and said end wall, and a pair of pivotally mounted legs, one mounted on each said member along the underside of said floor in close proximity to said front wall and said end wall, whereby said floor may be angularly adjusted relative to said underlying supporting surface.

2. The adjustable and extendable receptacle according to claim 1, wherein each said pivotally mounted leg includes a planar base member for removably attaching said receptacle to said underlying surface.

3. The adjustable and extendable receptacle according to claim 2, wherein each said base member includes a lower surface having means for removably attaching same to said underlying surface, and an upper surface having a channel-like member for receiving said pivotally mounted leg.

4. The adjustable and extendable receptacle according to claim 3, wherein said pivotally mounted leg includes a stem extending downwardly from said floor and terminating in a balled tip, where said balled tip is slidably received within said channel-like member and angularly movable relative thereto.

5. The adjustable and extendable receptacle according to claim 1, wherein each said vertically adjustable leg includes a threaded shank extending through and above said floor and a protective cover overlying said shank above said floor.

6. The adjustable and extendable receptacle according to claim 1, wherein the front and rear walls of one of said trough-like members is provided with flanges along the top edges thereof to facilitate sliding engagement with the other of said trough-like member.

* * * * *